US008157122B2

(12) United States Patent
Dale

(10) Patent No.: US 8,157,122 B2
(45) Date of Patent: Apr. 17, 2012

(54) LIDDED CONTAINER

(75) Inventor: James Patrick Dale, Huntingdon (GB)

(73) Assignee: Akzo Nobel Coatings International B.V., Arnhem (NL)

( * ) Notice: Subject to any disclaimer, the term of this patent is extended or adjusted under 35 U.S.C. 154(b) by 897 days.

(21) Appl. No.: 12/091,209

(22) PCT Filed: Oct. 3, 2006

(86) PCT No.: PCT/EP2006/066989

§ 371 (c)(1),
(2), (4) Date: Jun. 23, 2008

(87) PCT Pub. No.: WO2007/048681

PCT Pub. Date: May 3, 2007

(65) Prior Publication Data

US 2008/0308556 A1 Dec. 18, 2008

(30) Foreign Application Priority Data

Oct. 24, 2005 (EP) ..... 05109905

(51) Int. Cl.
*B65D 53/00* (2006.01)

(52) U.S. Cl. ..... 220/763; 215/10; 215/398; 222/465.1; 222/566; 222/567; 220/288; 220/377; 220/695; 220/696; 220/761; 220/766; 220/768; 220/773

(58) Field of Classification Search ..... 220/288, 220/763, 377, 695, 696, 761, 766, 768, 773; 215/10, 398; 222/465.1, 566, 567
See application file for complete search history.

(56) References Cited

U.S. PATENT DOCUMENTS

| | | | | |
|---|---|---|---|---|
| 2,120,487 | A | 6/1938 | Conner | |
| 2,786,495 | A * | 3/1957 | Benson | 141/370 |
| 3,387,749 | A * | 6/1968 | Godshalk et al. | 222/143 |
| 5,269,438 | A | 12/1993 | Kelsey | |
| 2003/0192921 | A1 | 10/2003 | Walsh et al. | |
| 2004/0240314 | A1 * | 12/2004 | Armendariz et al. | 366/209 |

FOREIGN PATENT DOCUMENTS

| | | |
|---|---|---|
| WO | WO 90/11228 | 10/1990 |
| WO | WO 03/047982 | 6/2003 |

OTHER PUBLICATIONS

International Search Report, Written Opinion and International Preliminary Report on Patentability, International Application No. PCT/EP2006/066989, mailed Dec. 14, 2006.

* cited by examiner

*Primary Examiner* — Anthony Stashick
*Assistant Examiner* — Elizabeth Volz
(74) *Attorney, Agent, or Firm* — Kenyon & Kenyon LLP

(57) ABSTRACT

A lidded container comprising a container body with side walls, a bottom, and a top end with an opening comprising means to retain a lid, and an upstanding edge around the opening having its outer sides in line with the side walls of the container. The upstanding edge is provided with at least one recess, which preferably inclines over the width of the upstanding edge from the opening downwardly to the edge's outer sides.

16 Claims, 4 Drawing Sheets

Figure 1:
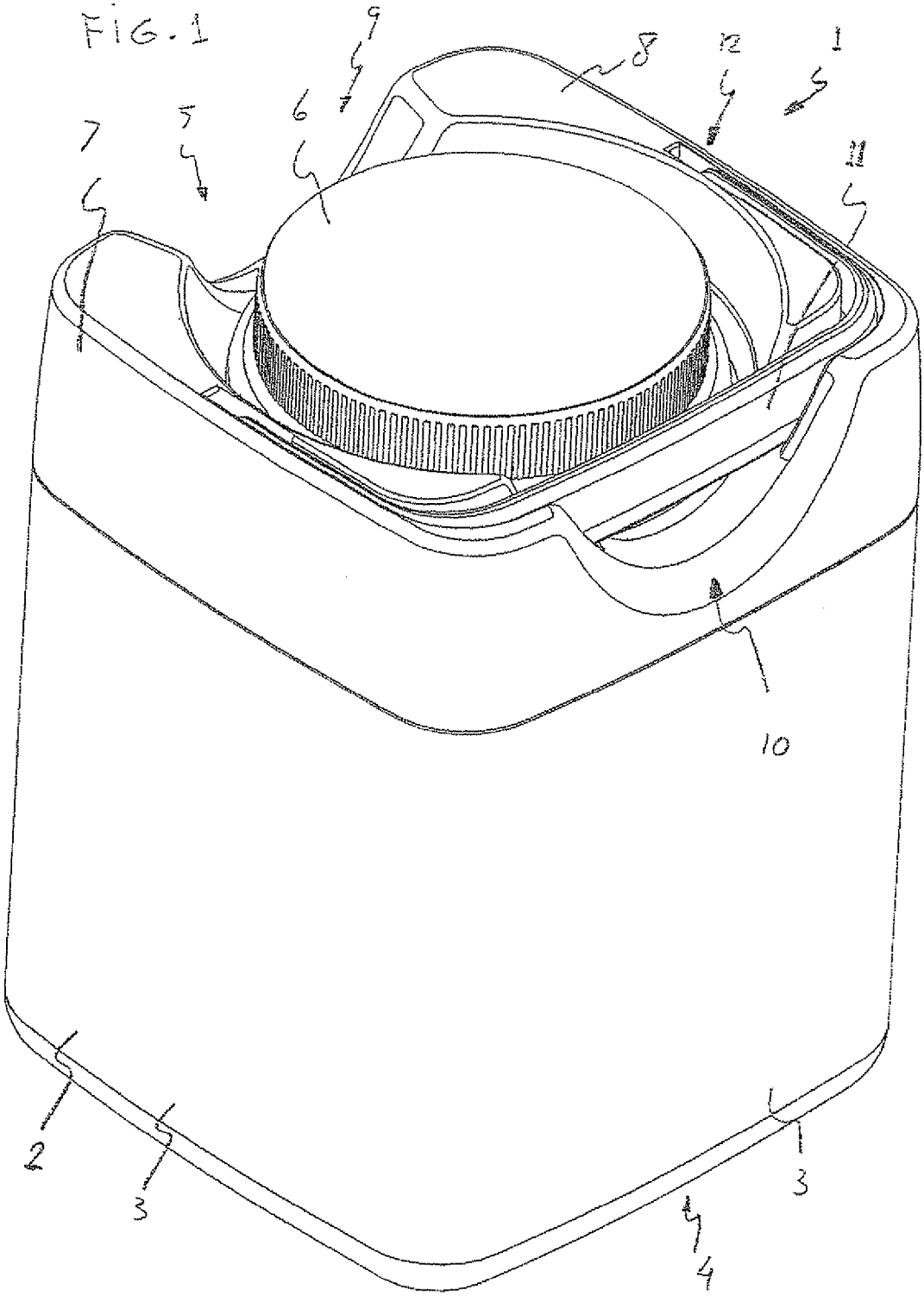

9
8
12
1
7
5
6
11
10
2
3
3
4

21
16
11
19
18
20
14
17
15
7
12
24
9
10
A
23
13
A
32
3
4

LIDDED CONTAINER

The invention relates to a lidded container suitable for liquid substances, in particular for paints, varnishes or lacquers. Lidded paint containers are for example known from WO 90/11228 and WO 03/047982. When they are used, the paint is generally poured into a tray or container which is easily accessible for a paint roller or a brush. Pouring out the paint can cause spoiling of paint, which is particularly annoying for non-professional and less well-prepared users. To pour out the paint, the container is tilted. After a sufficient quantity of paint has been poured out, the paint container is tilted back into its upright position and at a certain tilting angle the paint outflow will break and stop. At that particular moment, a smaller or larger drip of paint still hangs from the pouring opening before leaking away over the paint container's outside. Pouring spouts and similar provisions have been proposed to overcome the risk of spoiling. However, for reasons of stock, transport, and commercial presentation, the containers must be easily stackable and so should preferably be provided with a substantially flat upper side.

In view of these constructional considerations, it is the object of the present invention to provide a stackable paint container construed to minimize the risk of spoiling.

The object of the invention is achieved with a lidded container comprising a container body with side walls, a bottom, and a top end with an opening comprising means to retain a lid, and an upstanding edge around the opening having its outer sides in line with the side walls of the container, characterized in that the upstanding edge is provided with at least one recess. Whereas the upstanding edge provides a stable base for piling and stacking, the recess prevents the outflow of paint from contaminating the edge and, when the outflow of paint is interrupted, prevents the paint from dripping back onto the container's outside.

To keep effectively away from the paint flow, the recess may for instance incline over the width of the upstanding edge from the opening downwardly to the edge's outer sides. The opening can further be surrounded by a collar and the line between the top of the collar and the outer point of the recess makes an angle of about 45 degrees or less with the vertical. It has been found that when the container is turned back to its upright position after pouring, the paint outflow breaks at a tilting angle of about 45 degrees. If the line between the top of the collar and the outer point of the recess makes an angle of about 45 degrees or less with the vertical, the interrupted paint outflow will not drip back onto the recess.

The means to retain a lid can for example be a screw thread provided on the outside or the inside of the collar, to receive a correspondingly threaded lid. Other lid-retaining means, such as snap joints or the like, may also be used as an alternative if so desired.

The upstanding edge can also be used to pivotally mount a handle. In that case, the handle can for example be construed in such a way that it is pivotable between an upstanding use position and a rest position in which it is countersunk in a corresponding recess in the upstanding edge. This way, the handle does not hinder piling a stack of containers. Optionally, the handle may be provided with a stop so that it can only be turned down to the recess in the upstanding edge and not to the other side when it is turned into its rest position.

To mount it, the handle can for instance comprise a circular projection at both outer ends of its U-shape, which outer ends are embedded in a groove in the upstanding edge, one of the side walls of the groove being provided with a corresponding opening bearing the circular projection of the handle's outer end. The groove and the handle can be dimensioned in such a way that the handle will clamp itself in the groove in a way that does not hinder pivoting of the handle.

To further secure that connection between the handle and the shroud's groove, the circular projections of the handle's outer ends can be dimensioned in such a way that they widen outwardly at an angle with its longitudinal axis, e.g. of 15-20 degrees, while the edge of the opening in the side walls of the groove bearing the circular projection is chamfered at substantially the same angle.

Optionally, the upstanding edge may be a part of a separately formed shroud attached to a main container body comprising the opening. Such a shroud can for example have a thin-walled outer edge and an inner opening confined by an upstanding flanged inner edge, while the container opening in the main container body is confined by a widening edge fit to receive the flanged inner edge of the shroud, while the thin-walled outer edge of the shroud is supported by a ridge on the outer wall of the main container body. This way, the shroud is locked between the widened edge of the container opening and the ridge on the main container body. The vertical distance between the widened opening edge and the ridge on the container body can be dimensioned such as to form a close fit with the vertical distance between the outer end of the shroud's inner edge and the outer end of the shroud's outer edge, in order to prevent movement of the shroud relative to the main container body.

To facilitate easy but stable piling of the containers, the container can for example be provided with a lid protruding over the upstanding edge over a distance, whereas the container bottom is provided with a recess fitting over the protruding lid of a similar container when piled.

The container can be made of any suitable material, e.g. plastics such as polyethylene or polypropylene, for instance by injection moulding or any other suitable type of moulding. The container is particularly useful as a paint container, e.g., for water-based latex paints or other types of paints or lacquers.

Figure 2:
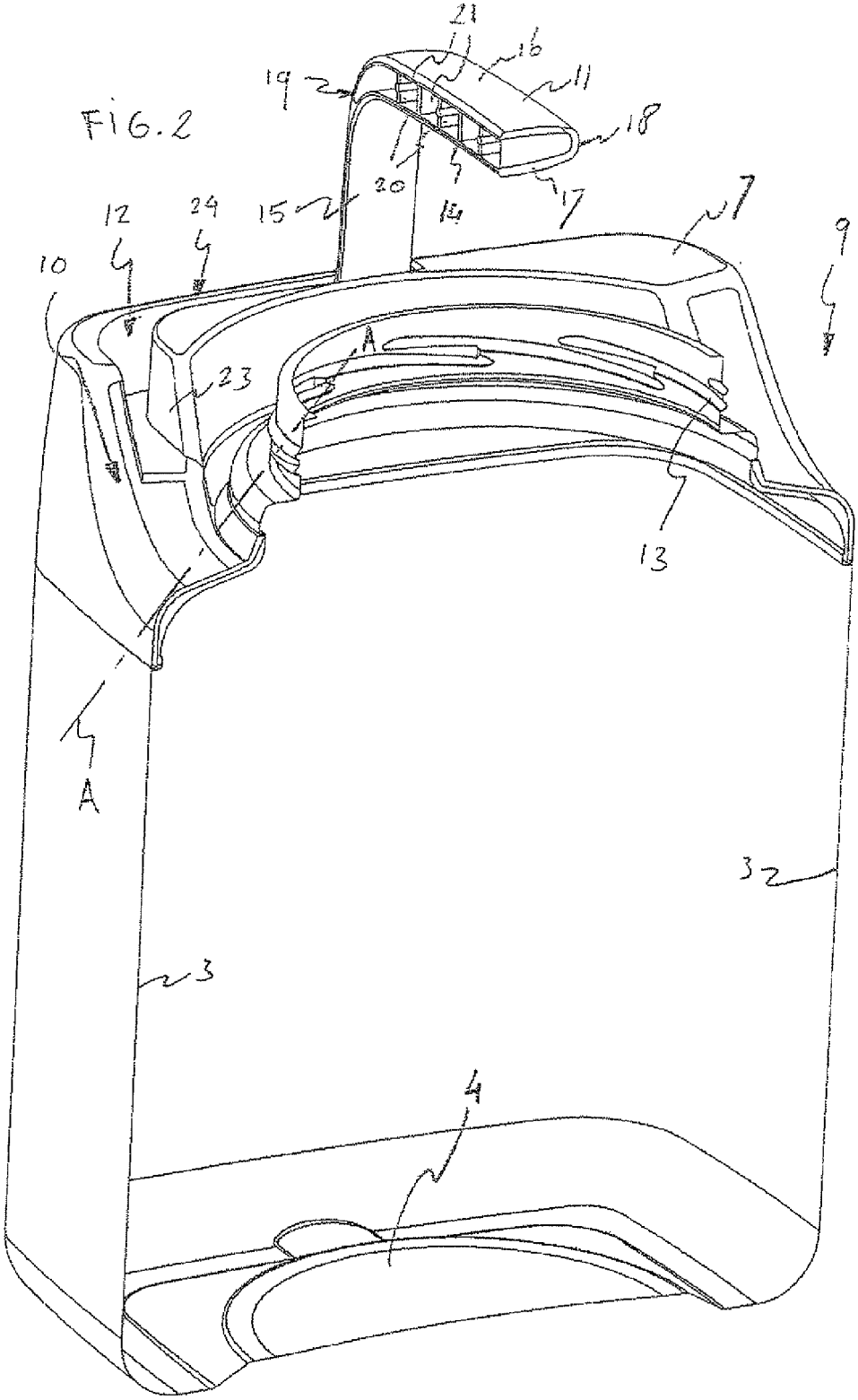
Figure 3:
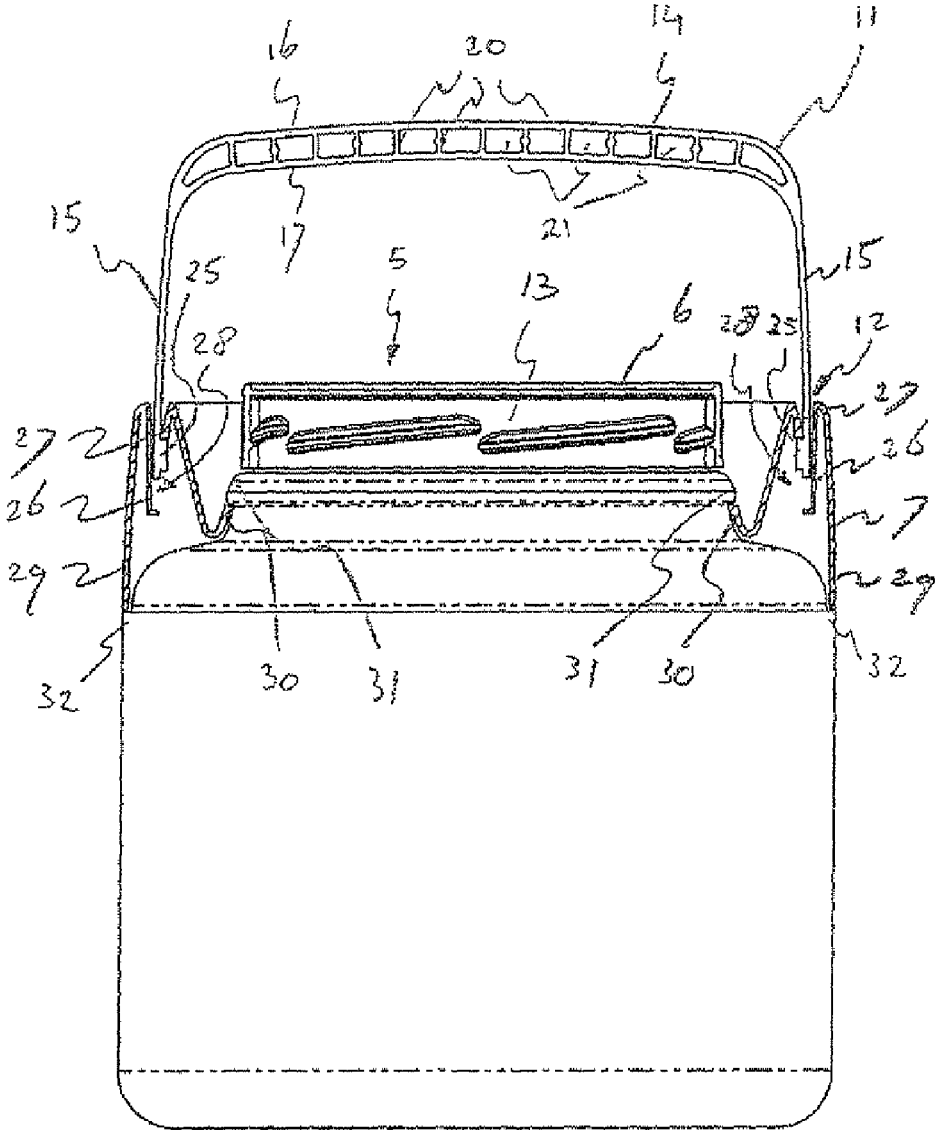
Figure 4:
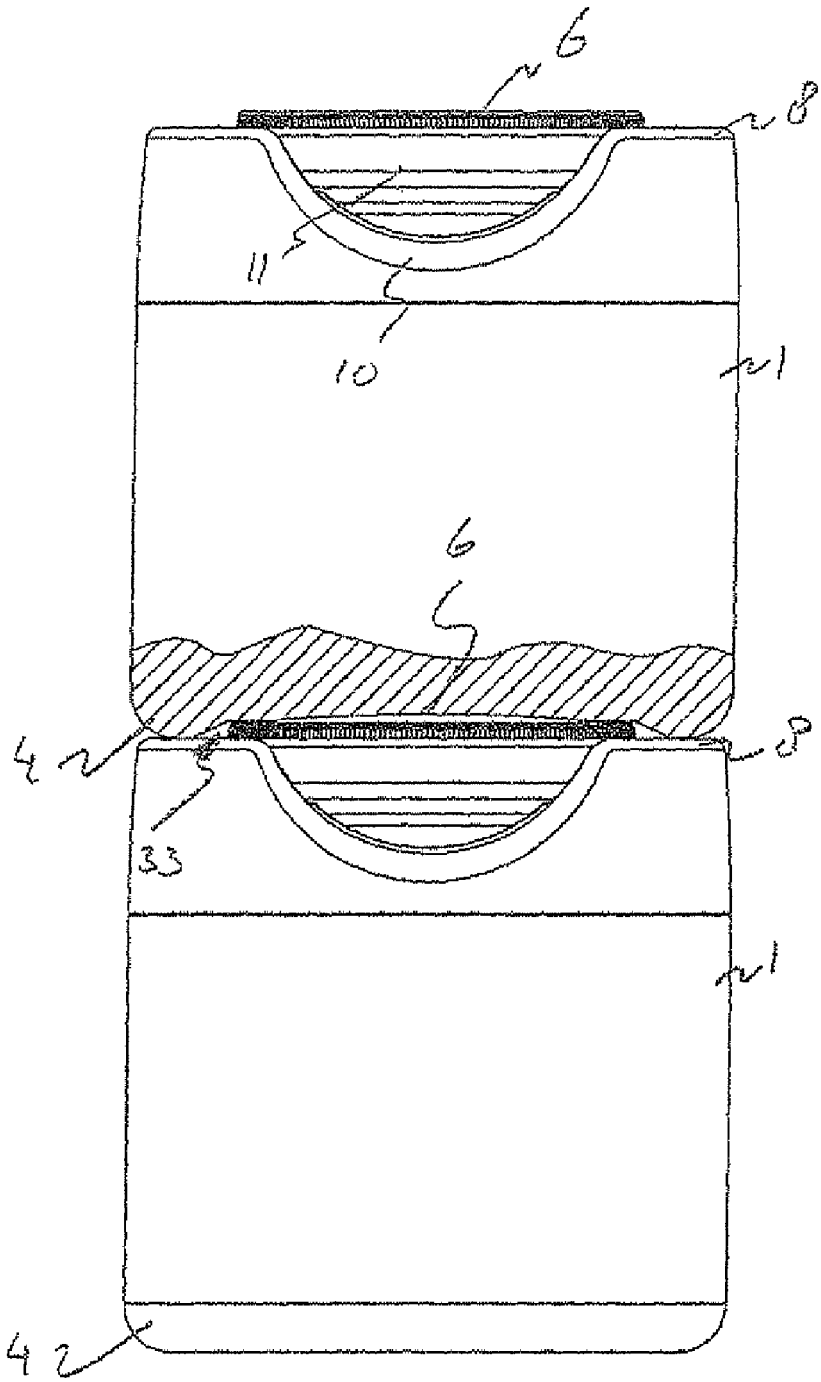

The invention is further illustrated by the accompanying drawings. In the drawings:

FIG. 1: shows in perspective a paint container according to the invention;

FIG. 2: shows in perspective the paint container of FIG. 1 cut in half;

FIG. 3: shows the paint container of FIG. 1 in side view with the shroud part and the lid in cross-section;

FIG. 4: shows two stacked paint containers according to the invention.

FIG. 1 shows a paint container 1 with a container body 2 with side walls 3, a bottom 4, and a top end 5 closed with a lid 6. A shroud 7 forms an upstanding edge 8 surrounding the lidded top end 5 of the container body 2. The outer sides of the shroud 7 are in line with the respective side walls 3 of the container body 2.

The upstanding edge 8 is provided with two opposite recesses 9, 10. The recesses 9, 10 incline over the width of the upstanding edge from the opening 5 downwardly to the edge's outer sides.

The container 1 further comprises a U-shaped handle 11, which can pivot between an upstanding position (as in FIG. 2) and a rest position (as in FIG. 1). In the rest position, the handle is embedded in a corresponding recess 12 in the shroud 7.

FIG. 2 shows half of the paint container 1 in perspective. The open top end 5 is surrounded by a threaded collar 13. Line A between the top edge of the collar 13 and the outer point of the recess 9, 10 makes an angle of about 45 degrees with the vertical. As a result, when after pouring the paint can 1 is turned back to an upright position, the paint outflow breaks off before it can come into contact with the shroud 7 or any other part of the paint container 1.

The handle 11 is U-shaped and has a central grip part 14 and pivoting handle legs 15. The central grip part 14 has closed top and down sides 16, 17, a rounded front side 18, and an open back side 19, where equidistantial separations 20 leave open cells 21 (see also FIG. 3).

The shroud 7 is provided with a groove 12 embedding the handle 11 when it is in the rest position. The shape of the groove 12 corresponds to the U shape of the handle 11, with a middle section 23 to receive the central grip part 14 of the handle 11, and side sections 24 at right angles with the middle section 23, to receive the handle legs 15 (see FIG. 1). The side sections 24 of the groove 12 end in the middle of the side of the upstanding edge 8 of the shroud 7. This way, half of the upstanding edge 8 of the shroud 7 is cut by the groove 12, while the opposite half of the shroud 7 is not. The recess 10 interrupts the upstanding edge 8 in the middle of the middle groove section 23. As a result, when the handle is laid in the rest position, it is easily accessible for a user via the recess 10. The recess 9 is opposite to the recess 10, not interrupting the groove 12.

FIG. 3 shows a side view of the paint container 1, with the shroud 7 and the lid 6 in cross-section and the handle 11 standing upright. The handle legs 15 are provided with inwardly protruding circular protrusions 25, pointing to each other. The groove 12 is confined by an outer wall 26 and an inner wall 27. At the outer end of the side sections 24, the inner wall 27 of the groove 12 is provided with an opening 28 bearing the circular protrusion 25 of the handle's outer end. The circular protrusions 25 widen outwardly and are wider at their outer faces than at a point closer to the handle leg 15. Correspondingly, the opening 28 in the side wall of the groove 12 bearing the circular protrusion 25 is chamfered at the same angle. The wall 27 is dimensioned such that when the handle is inserted it has sufficient flex to allow the pivot protrusion 25 to pass into position, and once in place it cannot be removed without destroying the assembly. The handle legs 15 entering the slot in the shroud 7 encounters the narrowing passage between wall 27 and the adjacent wall 26. The slot between walls 26 and 27 is such that it is only wide enough to accommodate the handle legs 15. During assembly, wall 27 can flex to allow the passage of the handle legs 15 with protrusions 25 down into the slot until protrusions 25 enter the mating slots in wall 27. Wall 27 then returns to its starting position where protrusions 25 engage, and prevent the handle from being removed from the shroud.

In an alternative embodiment, the protrusions 25 can be provided at the outer side of the handle legs 15, pointing away from each other. Correspondingly, the openings 28 for bearing the projections 25 should then be provided in the outer walls 26 of the groove 12.

The shroud 7 has a thin-walled outer edge 29 and an inner opening confined by an upstanding flanged inner edge 30. Below the collar 13, the container body 2 comprises a ridge 31 fit to receive the flanged inner edge 30 of the shroud 7, while the thin-walled outer edge 29 of the shroud 7 is supported by a ridge 32 on the outer wall of the main container body 2. The vertical distance between the ridge 31 and the ridge 32 is dimensioned such that it clamps the shroud 7.

FIG. 4 shows how the paint containers 1 can be stacked. To this end, the bottom 4 of the upper paint can 1 is partly shown in cross section. The lid 6 protrudes over the upstanding edge 8 over a certain distance. The container bottom 4 is provided with a recess 33 fitting over the protruding lid 6 of a similar container when piled.

The invention claimed is:

1. A lidded container comprising a container body with side walls, a bottom, and a top end with an opening comprising means to retain a lid, and an upstanding edge around the opening having its outer sides in line with the side walls of the container body, wherein the upstanding edge is part of a separately formed shroud attached to said container body and wherein said upstanding edge is provided with at least one recess, wherein said recess inclines over the width of the upstanding edge from the opening downwardly to the upstanding edge's outer sides.

2. The container according to claim 1, wherein the container is provided with a lid protruding over the upstanding edge over a distance and the container bottom is provided with a recess fitting over the protruding lid of a similar container when they are piled.

3. The container according to claim 1, wherein it is a paint container.

4. The container according to claim 1, wherein the opening is surrounded by a collar and wherein a line between the top of the collar and the outer point of the recess makes an angle of 45 degrees or less with the vertical.

5. The container according to claim 4, wherein the collar is provided with a screw thread.

6. The container according to claim 5, further comprising a handle pivotally mounted on the upstanding edge.

7. The container according to claim 1, wherein the shroud has a thin-walled outer edge and an inner opening confined by an upstanding flanged inner edge and in that the container opening in the main container body is confined by a widening edge fit to receive the flanged inner edge of the shroud, while the thin-walled outer edge of the shroud is supported by a ridge on the outer wall of the main container body.

8. The container according to claim 7, wherein the container is provided with a lid protruding over the upstanding edge over a distance and the container bottom is provided with a recess fitting over the protruding lid of a similar container when they are piled.

9. A container according to claim 8, wherein it is a paint container.

10. The container according to claim 1, further comprising a handle pivotally mounted on the upstanding edge.

11. The container according to claim 10, wherein the handle is pivotable between an upstanding use position and a rest position in which it is countersunk in a corresponding recess in the upstanding edge.

12. The container according to claim 11, wherein the handle comprises a circular projection at its outer ends and wherein the outer ends of the handle are embedded in a groove in the upstanding edge, one of the side walls of the groove being provided with an opening bearing the circular projection of the handle's outer end.

13. The container according to claim 10, wherein the handle comprises a circular projection at its outer ends and wherein the outer ends of the handle are embedded in a groove in the upstanding edge, one of the side walls of the groove being provided with an opening bearing the circular projection of the handle's outer end.

14. The container according to claim 13, wherein the circular projection of the handle's outer ends widens outwardly at an angle with its longitudinal axis and wherein the edge of the opening in the side walls of the groove bearing the circular projection is chamfered at substantially the same angle.

15. The container according to claim 14, wherein the container is provided with a lid protruding over the upstanding edge over a distance and the container bottom is provided with a recess fitting over the protruding lid of a similar container when they are piled.

16. The container according to claim 10, wherein the container is provided with a lid protruding over the upstanding edge over a distance and the container bottom is provided with a recess fitting over the protruding lid of a similar container when they are piled.

* * * * *